US006834402B2

(12) United States Patent
Hanson et al.

(10) Patent No.: US 6,834,402 B2
(45) Date of Patent: Dec. 28, 2004

(54) COMBINATION BED MOVER AND PATIENT TRANSFER APPARATUS

(75) Inventors: Thomas W. Hanson, Loveland, OH (US); Ronald S. Henderson, Indianapolis, IN (US)

(73) Assignee: Hill-Rom Services, Inc., Wilmington, DE (US)

( * ) Notice: Subject to any disclaimer, the term of this patent is extended or adjusted under 35 U.S.C. 154(b) by 0 days.

(21) Appl. No.: 10/247,991

(22) Filed: Sep. 20, 2002

(65) Prior Publication Data

US 2003/0074732 A1 Apr. 24, 2003

Related U.S. Application Data

(60) Provisional application No. 60/323,731, filed on Sep. 20, 2001.

(51) Int. Cl.[7] ..... A61G 7/08

(52) U.S. Cl. ..... 5/81.1 R; 5/88.1; 5/86.1; 180/209

(58) Field of Search ..... 5/81.1 R, 88.1, 5/81.1 HS, 81.1 T, 86.1, 600; 180/209, 11, 15, 16

(56) References Cited

U.S. PATENT DOCUMENTS

| | | | |
|---|---|---|---|
| 813,213 | A | 2/1906 | Johnson |
| 1,110,838 | A | 9/1914 | Taylor |
| 1,118,931 | A | 12/1914 | Hasley |
| 1,598,124 | A | 8/1926 | Evans |
| 1,639,801 | A | 8/1927 | Heise |
| 1,778,698 | A | 10/1930 | Walter |
| 2,224,087 | A | 12/1940 | Reichert |
| 2,599,717 | A | 6/1952 | Menzies |
| 2,635,899 | A | 4/1953 | Osbon, Jr. |
| 2,999,555 | A | 9/1961 | Stroud et al. |
| 3,004,768 | A | 10/1961 | Klages |

(List continued on next page.)

FOREIGN PATENT DOCUMENTS

| | | | |
|---|---|---|---|
| CA | 2010543 | | 9/1990 |
| DE | 1960444 | * | 12/1969 |
| DE | 1960444 | | 9/1970 |
| DE | 3500212 | A1 | 7/1985 |
| DE | 9420429 | U | 12/1996 |
| DE | 29518502 | U | 1/1997 |
| DE | 19921503 | A1 | 4/2000 |
| EP | 0093700 | A2 | 11/1983 |
| EP | 0420263 | A1 | 4/1991 |
| EP | 0630637 | A1 | 12/1994 |
| EP | 0630637 | | 12/1994 |
| EP | 0776637 | | 6/1997 |

(List continued on next page.)

OTHER PUBLICATIONS

Stryker Medical, 2040 Zoom™ Critical Care Bed Maintenance Manual, date unknown.
Motorvator 3 Product Features Webpage, May 10, 2000.
Stryker Corporation, Zoom™ Drive brochure, 3/00.
Midmark 530 Stretcher Information, Midmark Catalog, p. 14.
Hill–Rom On3 Product Brochure 2000.

*Primary Examiner*—Heather Shackelford
*Assistant Examiner*—Lisa M. Saldano
(74) *Attorney, Agent, or Firm*—Bose McKinney & Evans LLP

(57) ABSTRACT

A patient transport apparatus is provided. The patient transport apparatus includes a patient support mover configured to move a patient support relative to the floor and a patient transfer apparatus configured to move a patient from a first position on the patient support to a second position on the patient support.

18 Claims, 14 Drawing Sheets

U.S. PATENT DOCUMENTS 3,112,001 A 11/1963 Wise
3,304,116 A 2/1967 Stryker
3,305,876 A 2/1967 Hutt
3,380,546 A 4/1968 Rabjohn
3,393,004 A 7/1968 Williams
3,452,371 A 7/1969 Hirsch
3,544,127 A 12/1970 Dobson
3,618,966 A 11/1971 Banderves
3,680,880 A 8/1972 Blaauw
3,770,070 A 11/1973 Smith
3,814,199 A 6/1974 Jones
3,820,838 A 6/1974 Limpach
3,876,024 A 4/1975 Shieman et al.
4,137,984 A 2/1979 Jennings
4,164,355 A 8/1979 Eaton
4,167,221 A 9/1979 Edmonson
4,175,632 A 11/1979 Lassanlke
4,175,783 A 11/1979 Pioth
4,274,503 A 6/1981 Mackintosh
4,275,797 A 6/1981 Johnson
4,415,049 A 11/1983 Wereb
4,415,050 A 11/1983 Nishida
4,439,879 A 4/1984 Werner
4,444,284 A 4/1984 Montemurro
4,475,611 A 10/1984 Fisher
4,475,613 A 10/1984 Walker
4,513,832 A 4/1985 Engman
4,566,707 A 1/1986 Nitzberg
4,584,989 A 4/1986 Stith
4,629,242 A 12/1986 Schrager
4,723,808 A 2/1988 Hines
4,724,555 A 2/1988 Poehner
4,759,418 A 7/1988 Goldenfeld et al.
4,771,840 A 9/1988 Keller
4,807,716 A 2/1989 Hawkins
4,811,988 A 3/1989 Immel
4,895,040 A 1/1990 Soederberg
4,922,574 A 5/1990 Helligenthal et al.
4,938,493 A 7/1990 Okuda
4,949,408 A 8/1990 Trkla
4,979,582 A 12/1990 Forster
4,981,309 A 1/1991 Froeschle
5,060,327 A 10/1991 Celestina et al.
5,060,959 A 10/1991 Davis et al.
5,069,465 A 12/1991 Stryker et al.
5,083,625 A * 1/1992 Bleicher ..... 180/65.1
5,084,922 A 2/1992 Louit
5,094,314 A 3/1992 Hayata
5,117,521 A 6/1992 Foster et al.
5,121,806 A 6/1992 Johnson
5,156,226 A 10/1992 Boyer et al.
5,181,762 A 1/1993 Beumer
5,187,824 A 2/1993 Stryker
5,201,819 A 4/1993 Shiraishi et al.
5,222,567 A 6/1993 Broadhead et al.
5,232,065 A 8/1993 Cotton
5,244,225 A 9/1993 Frycek
5,251,429 A 10/1993 Minato et al.
5,255,403 A 10/1993 Ortiz
5,279,010 A 1/1994 Ferrand et al.
5,284,218 A 2/1994 Rusher, Jr.
5,293,950 A 3/1994 Marliac
5,307,889 A 5/1994 Bohannan
5,322,306 A 6/1994 Coleman
5,337,845 A * 8/1994 Foster et al. ..... 180/11
5,348,326 A 9/1994 Fullenkamp et al.
5,358,265 A 10/1994 Yaple
5,366,036 A 11/1994 Perry
5,381,572 A 1/1995 Park
5,388,294 A 2/1995 Reeder
5,406,778 A 4/1995 Lamb et al.
5,439,069 A 8/1995 Beeler
5,445,233 A 8/1995 Fernie et al.
5,447,317 A 9/1995 Gehlsen et al.
5,477,935 A 12/1995 Chen
5,495,904 A 3/1996 Zwaan et al.
5,526,890 A 6/1996 Kadowaki
5,535,465 A 7/1996 Hannant
5,562,091 A 10/1996 Foster et al.
5,570,483 A 11/1996 Williamson
5,580,207 A 12/1996 Kiebooms et al.
5,613,252 A 3/1997 Yu et al.
5,651,149 A 7/1997 Garman
5,669,086 A 9/1997 Garman
5,687,437 A 11/1997 Goldsmith
5,690,185 A 11/1997 Sengel
5,697,623 A 12/1997 Bermes et al.
5,737,782 A 4/1998 Matsuura et al.
5,749,424 A 5/1998 Reimers
5,775,456 A 7/1998 Reppas
5,806,111 A 9/1998 Heimbrock et al.
5,809,755 A 9/1998 Velke et al.
5,839,528 A 11/1998 Lee
5,906,017 A 5/1999 Ferrand et al.
5,915,487 A 6/1999 Splittstoesser et al.
5,921,338 A 7/1999 Edmondson
5,934,694 A 8/1999 Schugt et al.
5,937,961 A 8/1999 Davidson
5,964,313 A 10/1999 Guy
5,971,091 A 10/1999 Kamen et al.
5,983,425 A 11/1999 DiMucci et al.
5,987,671 A 11/1999 Heimbrock et al.
5,988,304 A 11/1999 Behrendts
5,996,149 A 12/1999 Heimbrock et al.
6,016,580 A 1/2000 Heimbrock et al.
6,035,561 A 3/2000 Paytas et al.
6,059,060 A 5/2000 Kanno et al.
6,059,301 A 5/2000 Skarnulis
6,062,328 A 5/2000 Campbell et al.
6,065,555 A 5/2000 Yuki et al.
6,070,679 A 6/2000 Berg et al.
6,073,285 A 6/2000 Ambach et al.
6,076,208 A 6/2000 Heimbrock et al.
6,076,209 A 6/2000 Paul
6,105,348 A 8/2000 Turk et al.
6,125,957 A 10/2000 Kauffmann
6,131,690 A 10/2000 Galando et al.
6,148,942 A 11/2000 Mackert, Sr.
6,173,799 B1 1/2001 Miyazaki et al.
6,178,575 B1 1/2001 Harada
6,179,074 B1 1/2001 Scharf
6,256,812 B1 7/2001 Bartow et al.
6,378,148 B1 * 4/2002 Votel ..... 5/81.1 HS
6,496,991 B1 * 12/2002 Votel ..... 5/81.1 HS
2002/0029418 A1 3/2002 Votel
2002/0170114 A1 * 11/2002 Wolcott ..... 5/488

FOREIGN PATENT DOCUMENTS

EP 0776648 6/1997
FR 2714008 12/1996
FR 2735019 12/1996
FR 2 746 060 9/1997
GB 672557 5/1952
GB 2285393 7/1995
GB 2285393 A 7/1995
JP 46-31490 9/1971
JP 47-814 8/1972
JP 47-17495 10/1972
JP 48-44792 6/1973
JP 48-44793 6/1973
JP 48-54494 7/1973

| | | |
|---|---|---|
| JP | 48-54495 | 7/1973 |
| JP | 49-29855 | 8/1974 |
| JP | 51-20491 | 2/1976 |
| JP | 53-9091 | 1/1978 |
| JP | 53-96397 | 8/1978 |
| JP | 56-68523 | 6/1981 |
| JP | 56-68524 | 6/1981 |
| JP | 56-73822 | 6/1981 |
| JP | 57-157325 | 10/1982 |
| JP | 57-187521 | 11/1982 |
| JP | 58-63575 | 4/1983 |
| JP | 59-37946 | 3/1984 |
| JP | 59-38176 | 3/1984 |
| JP | 59-183756 | 10/1984 |
| JP | 59-186554 | 10/1984 |
| JP | 60-12058 | 1/1985 |
| JP | 60-12059 | 1/1985 |
| JP | 60-21751 | 2/1985 |
| JP | 60-31749 | 2/1985 |
| JP | 60-31750 | 2/1985 |
| JP | 60-31751 | 2/1985 |
| JP | 60-122561 | 7/1985 |
| JP | 60-188152 | 9/1985 |
| JP | 60-188153 | 9/1985 |
| JP | 61-188727 | 11/1986 |
| JP | 62-60433 | 4/1987 |
| JP | 64-17231 | 1/1989 |
| JP | 2-84961 A | 3/1990 |
| JP | 3-31063 | 2/1991 |
| JP | 4-108525 | 9/1992 |
| JP | 6-50631 | 7/1994 |
| JP | 6-237959 | 8/1994 |
| JP | 7-136215 | 5/1995 |
| JP | 7-328074 | 12/1995 |
| JP | 8-112244 | 5/1996 |
| JP | 8-317953 A | 12/1996 |
| JP | 9-24071 | 1/1997 |
| JP | 9-38154 A | 2/1997 |
| JP | 9-38155 A | 2/1997 |
| JP | 10-146364 A | 8/1998 |
| JP | 2000-107230 | 4/2000 |
| JP | 2000-175974 | 6/2000 |
| WO | WO82/01313 | 4/1982 |
| WO | WO94/16935 | 8/1994 |
| WO | WO96/13239 | 5/1996 |
| WO | WO97/39715 | 10/1997 |
| WO | WO00/37222 | 6/2000 |
| WO | WO00/51830 | 9/2000 |
| WO | WO00/59441 | 10/2000 |
| WO | WO01/19313 A1 | 3/2001 |

* cited by examiner

COMBINATION BED MOVER AND PATIENT TRANSFER APPARATUS

This application claims priority to U.S. Provisional Patent Application No. 60/323,731, to Hanson, et al., filed Sep. 20, 2001, the disclosure of which is expressly incorporated by reference herein.

BACKGROUND AND SUMMARY OF THE INVENTION

The present invention relates to an apparatus for use with a patient support, such as a hospital-type bed. More particularly, the present invention relates to apparatus configured to transfer a patient from a first patient support to a second patient support.

Different types of tables, beds, and other patient supports are well known in the health care industry for supporting patients during surgical procedures and for supporting patients generally while in a hospital, home, nursing home, or the like. In recent years, patient supports have been made even more useful and convenient for doctors and nurses by adding various features and options, such as powered articulation of head, torso, and leg sections of the patient support, height adjustment, tilt adjustment, etc.

Patient supports typically are capable of supporting a maximum patient weight of about six hundred pounds. Typically, different patient supports are used for surgery, transport, and rest. Therefore, when a patient is to be taken from resting to surgery, the patient must be moved from a rest bed to a transport bed; transported to the operating room; and moved from the transport bed to a surgery table. Heavy patients, especially those patients that are infirm, often have trouble moving themselves from one bed to another and from one location in a care facility to another. It is similarly difficult for a caregiver to move the patient about in these situations. Further, caregivers are of many different strengths. Thus, a patient that may be easy for one caregiver to move may be difficult for another caregiver to move.

According to the present invention, a patient transport apparatus is provided to move a patient support having a patient rest surface. The apparatus includes a patient support mover and a patient transfer apparatus configured to move the patient from a first position on the patient support to a second position on the patient support.

According to one embodiment of the present invention, the patient support mover includes a base, a plurality of wheels supporting the base on a floor, an attachment apparatus configured to couple the patient support mover to the patient support, and a drive mechanism configured to move the patient support relative to the floor. The patient transfer apparatus is supported by the patient support mover.

According to another aspect of the present invention, a patient transport apparatus is provided that is configured to move a patient from a first position on a patient rest surface of a patient support to a second position.

According to one embodiment, the apparatus includes a base, a patient transfer apparatus configured to move the patient, and a support member positioned to support the patient transfer apparatus on the base and permit adjustment of the position of the patient transfer apparatus relative to the base.

According to another embodiment, the patient transport apparatus includes a rod configured to be positioned adjacent head end of the patient support. The rod is configured to pull the patient longitudinally along the patient support.

According to another embodiment, a patient transfer apparatus is provided that includes a rod configured to be coupled to a sheet positioned under a patient and a patient mover. The rod is adjustable from a first length to a second length that is greater than the first length. The patient mover is coupled to the rod to move the sheet and patient positioned thereon from the first position to the second position.

According to another aspect of the invention, a method is provided for moving one or more patients longitudinally on a patient support having head and foot ends and first and second spaced apart sides extending between the head and foot ends. The method includes the steps of providing a rod configured to couple with a sheet positioned under a patient supported on a patient support and a patient mover configured to couple with the rod and move the rod, sheet, and patient relative to the patient support, coupling the rod to the sheet to extend laterally relative to the patient support, and moving the rod and sheet longitudinally with the patient mover to move the patient.

According to one embodiment of the invention, the method further comprises the steps of uncoupling the rod from the sheet, coupling the rod to a sheet to extend longitudinally relative to the patient support, and moving the rod and sheet laterally with the patient mover to move a patient Additional features of the present invention will become apparent to those skilled in the art upon consideration of the following detailed description of an illustrated embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
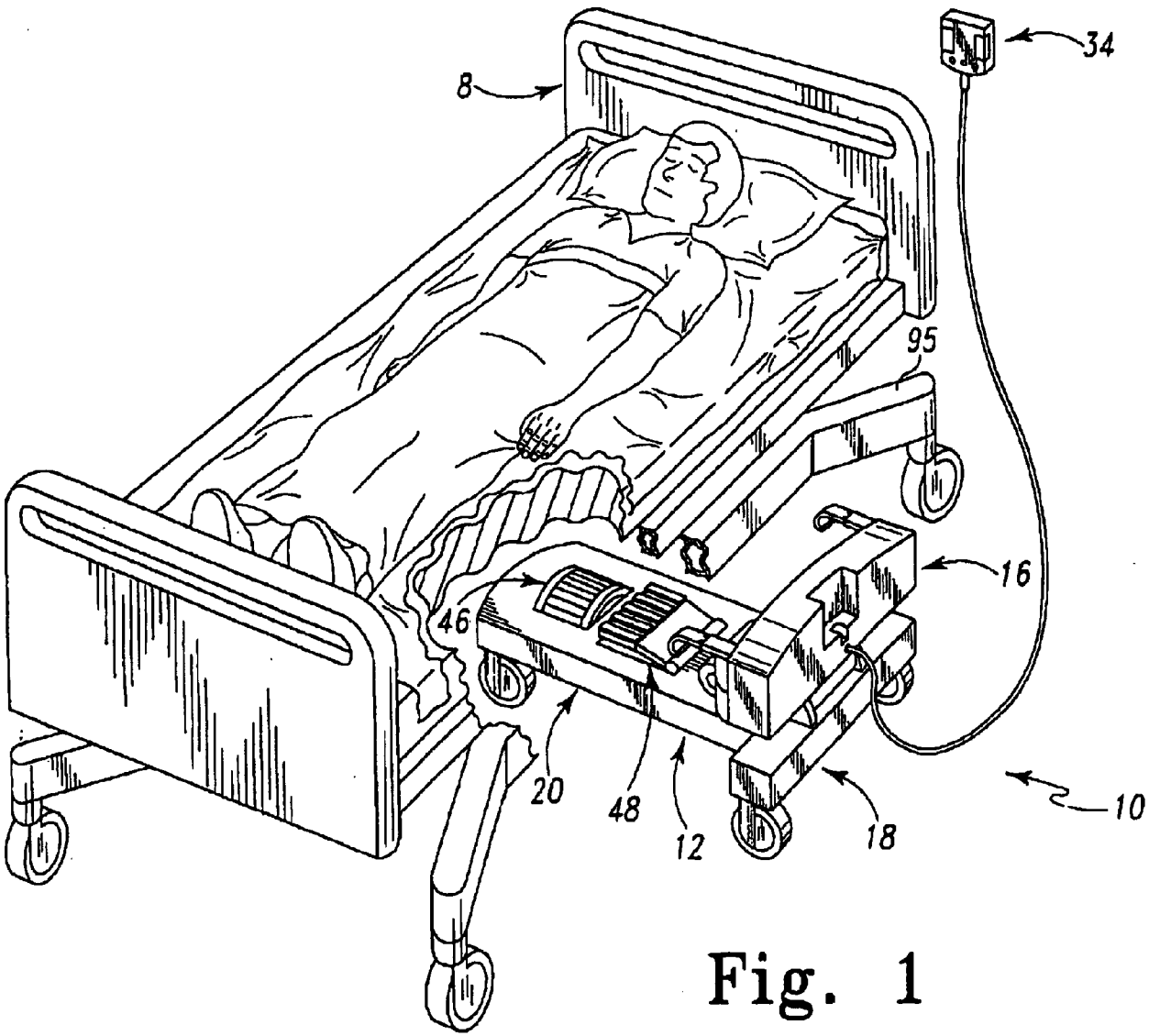
FIG. 1 a perspective view of a patient support, with portions broken way, and a patient transport apparatus showing the patient transport apparatus positioned under the patient support to move it from one location in a care facility to another.

As shown in FIG. 1, a patient transport apparatus 10 is provided that is configured to assist in moving a patient support 8 such as a hospital bed, gurney, or the like from one location in a care facility to another. Furthermore, patient transport apparatus 10 is also configured to assist a caregiver in transferring a patient from patient support 8 to another patient support or gurney 178, see, for example, FIGS. 2 and 3, or in shifting a patient from one position on patient support 8 to another, see, for example, FIGS. 4 and 5.

Patient support 8 is typically configured to provide support for a patient during an illness, performance of a medical procedure, or recovery from a medical procedure. According to the preferred embodiment of the present disclosure, patient support 8 includes a frame 11, a headboard 13 coupled to frame 11, a footboard 15 coupled to frame 11, and a mattress 17 that defines a patient rest surface 9. According to alternative embodiments of the present disclosure, other configurations of patient supports known to those of ordinary skill in the art are provided.

Figure 6:
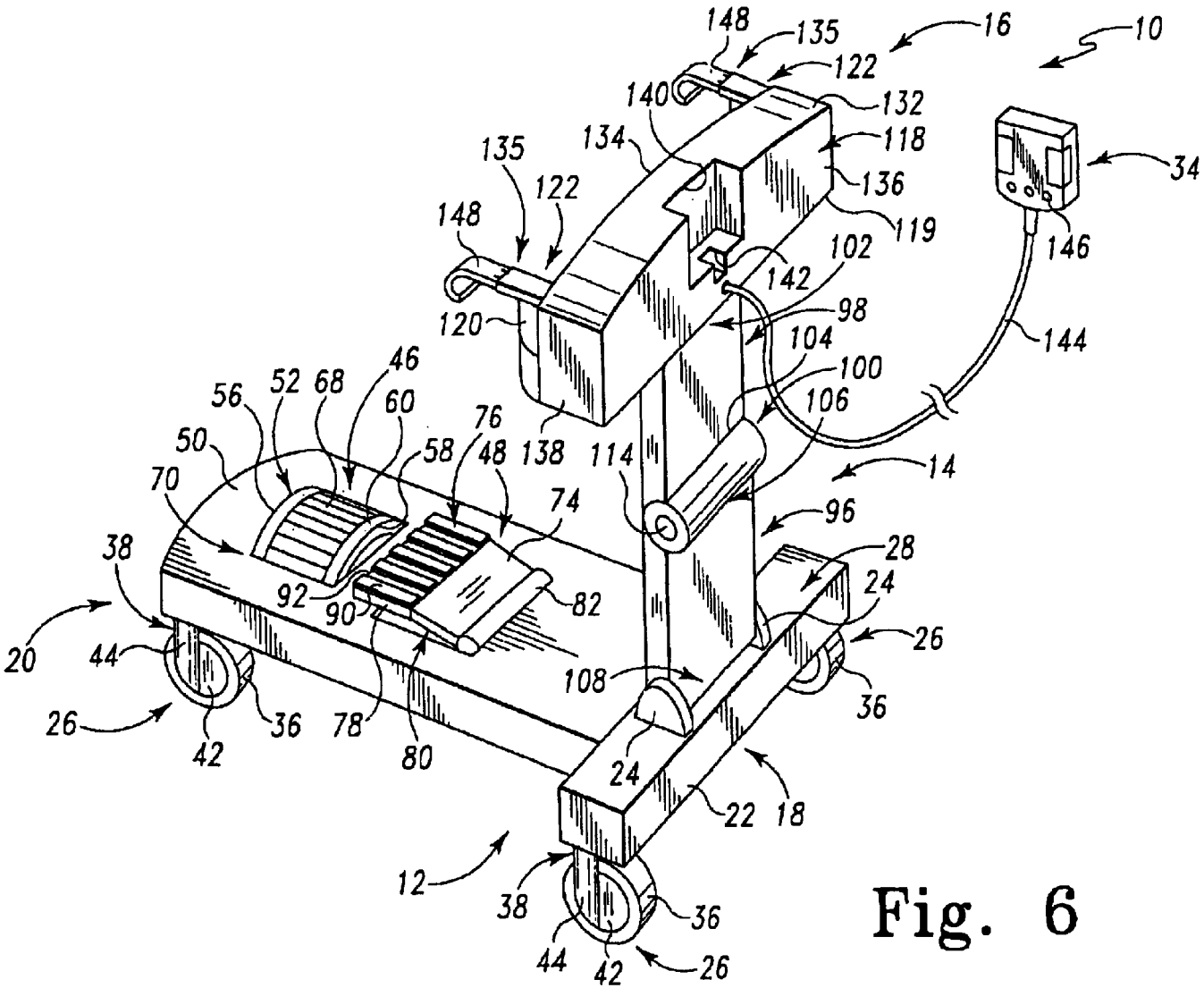
FIG. 6 is a perspective view of the patient transport apparatus showing the patient transport apparatus including a patient support mover including a base, wheels supporting the base on the floor, a bed attachment apparatus coupled to the base, and a drive wheel configured to move the base, a pedestal supported by the patient support mover, and a patient transfer apparatus supported by the pedestal.
Figure 7:
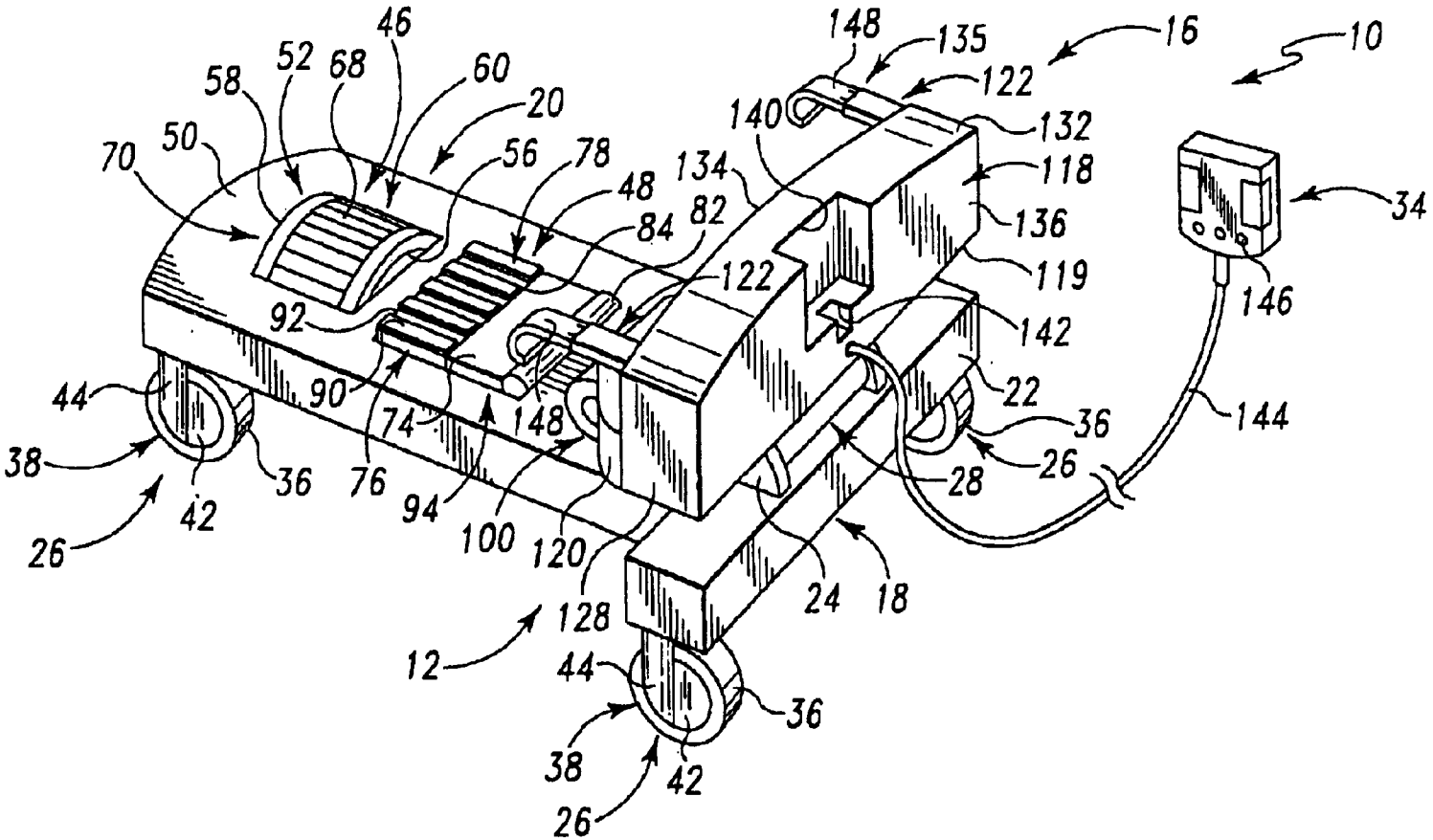
FIG. 7 is a view similar to FIG. 6 showing the pedestal in a lowered position.

Patient transport apparatus 10 is provided to assist a caregiver in moving patient support 8 about a care facility. As shown in FIG. 6, patient transport apparatus 10 includes a patient support mover 12 configured to assist in moving patient support 8 from one location to another, a pedestal or support member 14, and a patient transfer apparatus 16 configured to assist in transferring a patient from one patient support to another or in shifting a patient on a patient support. According to one embodiment of the present disclosure, the patient transport apparatus is not provided with a patient support mover. According to another embodiment, the patient transport apparatus is not provided with a patient transfer apparatus and support member.

Patient support mover 12 has a relatively low profile and includes a base or housing 50, a plurality of wheels 26 that support housing 50 on the floor, a drive mechanism 46 that provides the power to move patient support 8, and a bed attachment apparatus 48 that couples patient transport apparatus 10 to patient support 8. Drive mechanism 46 and bed attachment apparatus 48 are substantially positioned in housing 50 and wheel members 26 extend therefrom.

Drive mechanism 46 is configured to move patient support 8 forward and backwards to assist in moving patient support 8 about a care facility. Drive mechanism 46 includes a drive wheel 52, a bracket 54 configured to couple drive wheel 52 to housing 50, and a drive motor (not shown). Examples of suitable drive mechanisms are provided in U.S. Provisional Patent Application Serial No. 60/218,612, to Hanson et al. and U.S. Provisional Patent Application Serial No. 60/203,214 to Hanson, the disclosures of which are incorporated herein by reference. According to alternative embodiments of the present disclosure, other drive mechanisms known to those of ordinary skill in the art are provided to propel the patient support. According to other alternative embodiments, the drive mechanism is also configured to move the patient support from side-to-side.

Drive wheel 52 includes first and second sides 56, 58 and an outer surface 60. First and second sides 56, 58 are circular in shape and each include an aperture for receiving a shaft that extends to bracket 54. Outer surface 60 is preferably made of rubber or another high friction material to increase the grip of drive wheel 52 on the floor.

Figure 8:
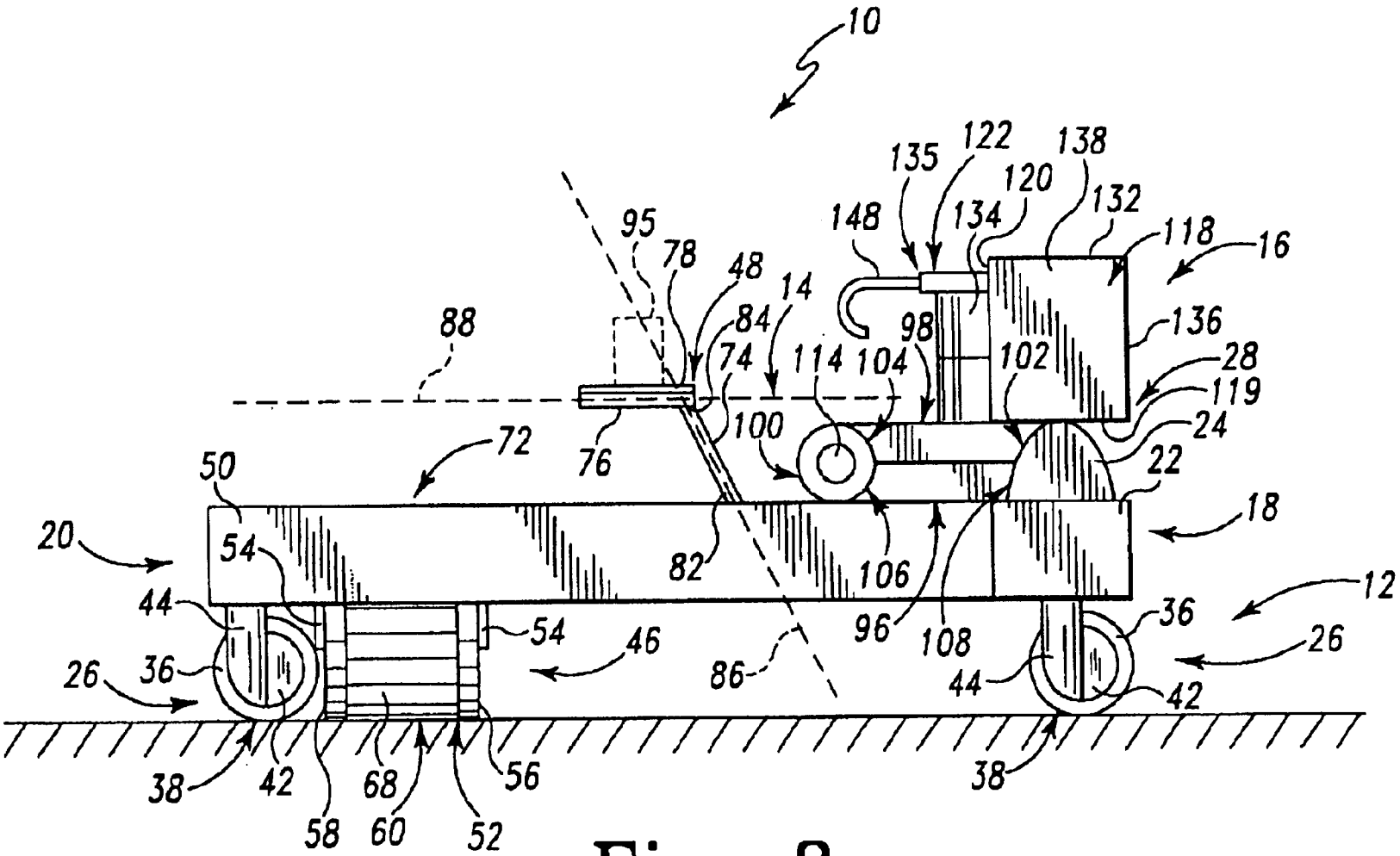
FIG. 8 is a side view of the patient transport apparatus of FIG. 6 showing the bed attachment apparatus engaging a frame member (shown in phantom) of the patient support.

Drive mechanism 46 is configured to lower and raise drive wheel 52 into and out of contact with the floor. To provide contact with the floor, drive mechanism 46 lowers bracket 54, and thus drive wheel 52 as shown in FIG. 8. Once in full contact with the floor, the caregiver energizes the drive motor to rotate drive wheel 52 in the desired direction. The functions of the drive motor are controlled by a keypad 34 that is coupled to patient transfer apparatus 16. When it is no longer desirable to have drive wheel 52 in contact with the floor, drive mechanism 46 raises drive wheel 52 as shown in FIGS. 6, 7, 9, and 10.

Figure 13:
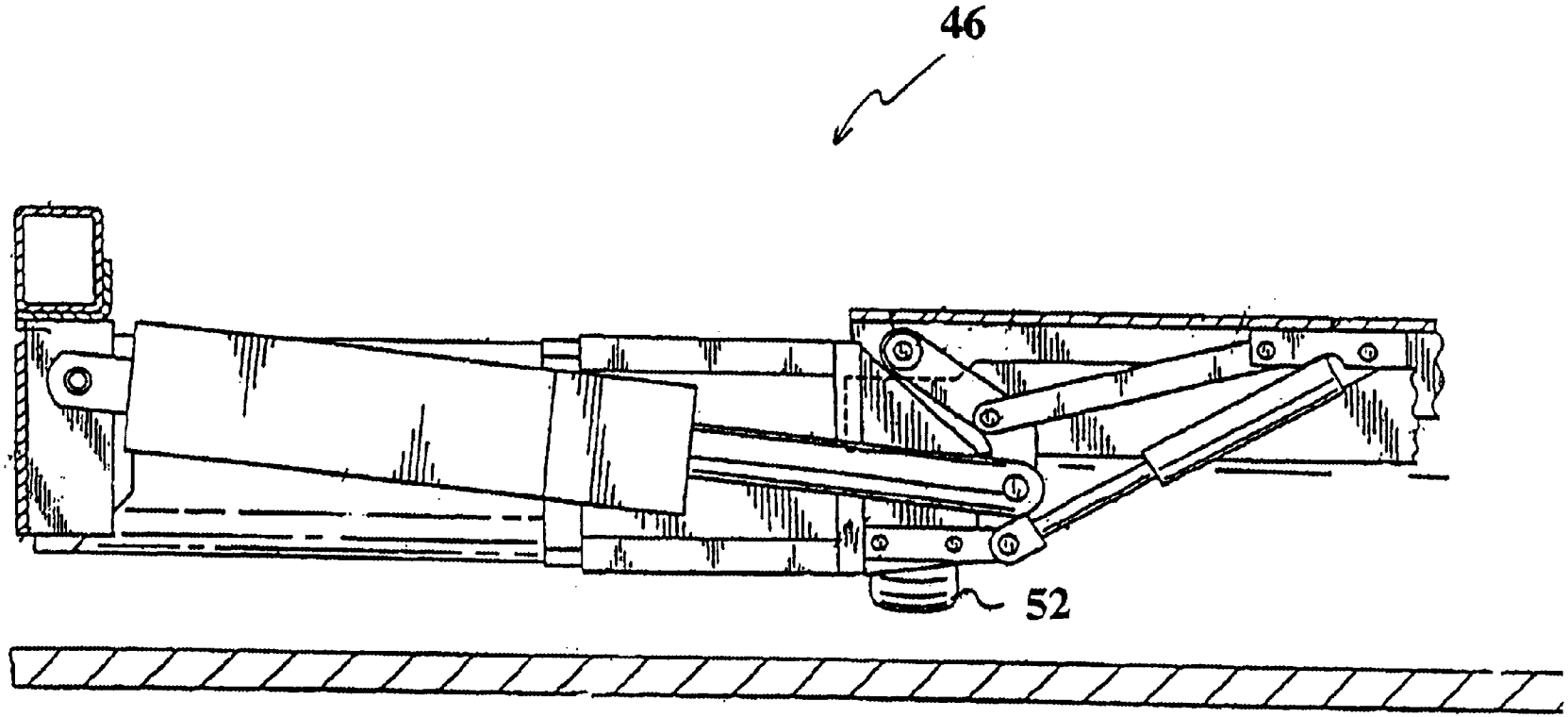
FIGS. 13 and 14 are partially cut-away side views of the drive wheel of the patient transfer apparatus.
Figure 14:
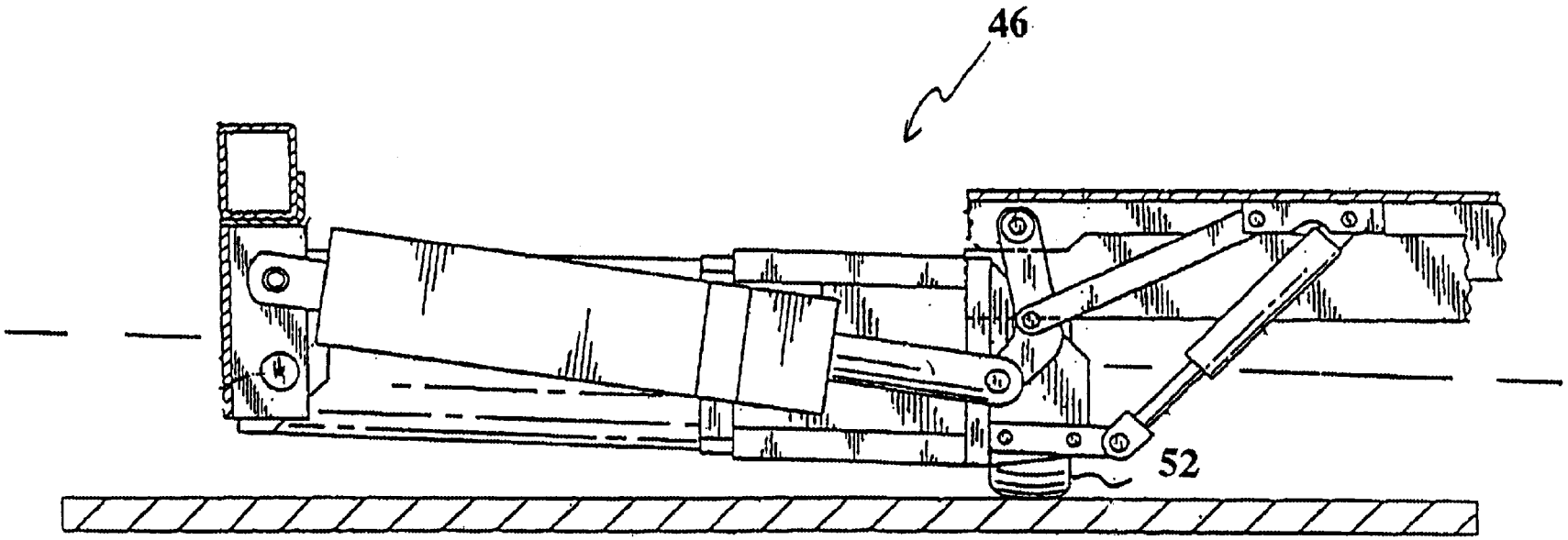

FIGS. 13–14 show a example of a drive mechanism 46 that can be used to raise and lower drive wheel 52 into and out of contact with the floor. Such a mechanism 46 is described more fully in U.S. Provisional Application Serial No. 60/203,214 which was previously incorporated by reference.

Bed attachment apparatus 48 is configured to couple housing 50 to patient support 8 so that movement of housing 50 by drive mechanism 46 is transferred to patient support 8. Bed attachment apparatus 48 includes a lift mechanism (not shown), a lift link 74 coupled for movement by the lift mechanism, a pressure plate 76 coupled to lift link 74, and a grip pad 78 positioned to contact a frame member 95 of patient support 8 as shown in FIG. 8. Lift plate 74 has a first end 82 hingedly coupled housing 50 and a second end 84 supporting pressure plate 76 and grip pad 78. The lift mechanism acts on lift plate 74 to raise and lower second end 84 of lift plate 74, pressure plate 76, and grip pad 78. According to the preferred embodiment, the lift mechanism includes an actuator coupled to lift plate 74 to move lift plate 74 between various positions. According to alternative embodiments, other mechanisms known to those of ordinary skill in the art are provided for moving the lift plate. According to alternative embodiments, other mechanisms are provided for coupling the patient transport apparatus to the patient support. For example, according to some embodiments latches, locks, clamps, pins, sockets, or other couplers are provided.

When positioned under frame member 95 and raised, grip pad 78 provides frictional contact between patient support 8 and patient transport apparatus 10. Preferably, grip pad 78 is made of a rubber material that includes alternating raised portions 90 and trough portions 92 to increase the grip on frame member 95. According to alternative embodiments of the present disclosure, the grip pad is made of other materials having high coefficients of friction, such as the material used for traction surface 68.

Figure 9:
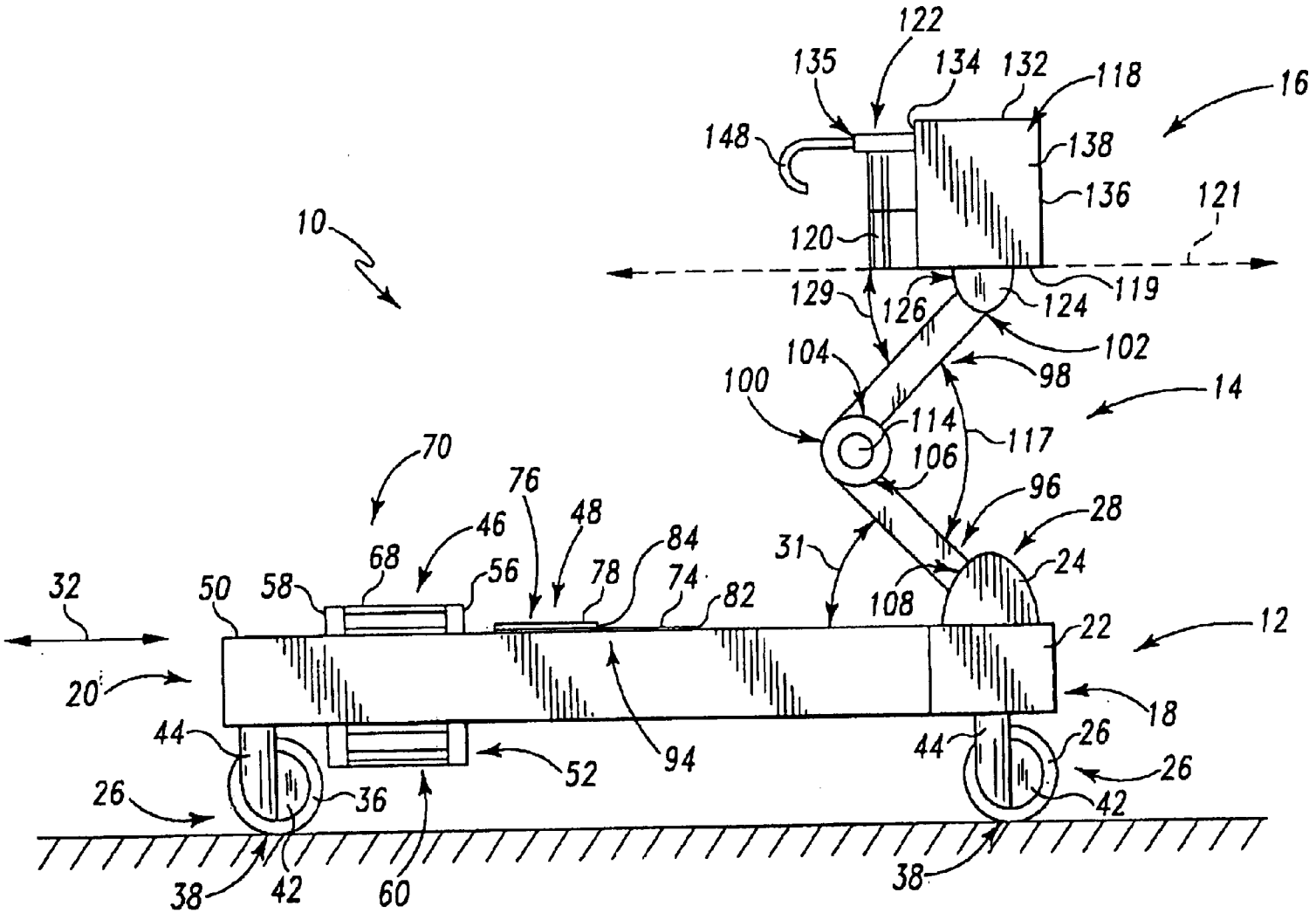
FIG. 9 is a view similar to FIG. 8 showing the pedestal in an intermediate position.

As shown in FIG. 6, housing 50 includes a recess 80 that is sized to allow lift plate 74 and pressure plate 76 to move to a lowered position spaced apart from frame member 95. When in a lowered position, only raised portions 90 of grip pad 78 extend out of recess 80, as shown in FIG. 9.

In operation, lift plate 74 rotates through an angle of 65 degrees relative to top surface of housing 50. When in the lowered position, lift plate 74 is substantially parallel with the top surface of housing 50 and lift plate 74 is positioned in recess 80 with pressure plate 76. During raising of pressure plate 76, the angle between lift plate 74 and the top surface of housing 50 increases. When the angle between pressure plate 76 and the top surface of housing 50 is equal to 65 degrees, pressure plate 76 is at its maximum height.

During rotation of lift plate 74, pressure plate 76, and thus grip pad 78 are raised until grip pad 78 engages frame member 95 of patient support 8. After the initial engagement, lift plate 74 continues to raise grip pad 78 compressing grip pad 78 between pressure plate 76 and frame member 95. This compression provides additional "grip" between patient transport apparatus 10 and frame member 95 of patient support 8 to help avoid slipping therebetween so that any movement of patient transport apparatus 10 is translated to patient support 8. This additional movement also applies additional weight to drive wheel 52 creating additional grip between drive wheel 52 and the floor.

After grip pad 78 is raised into contact with patient support 8, the drive motor rotates drive wheel 52 in the desired direction to propel patient support 8. After patient support 8 is transported to the desired location, grip pad 78 is lowered to provide clearance between patient transport apparatus 10 and patient support 8.

Figure 2:
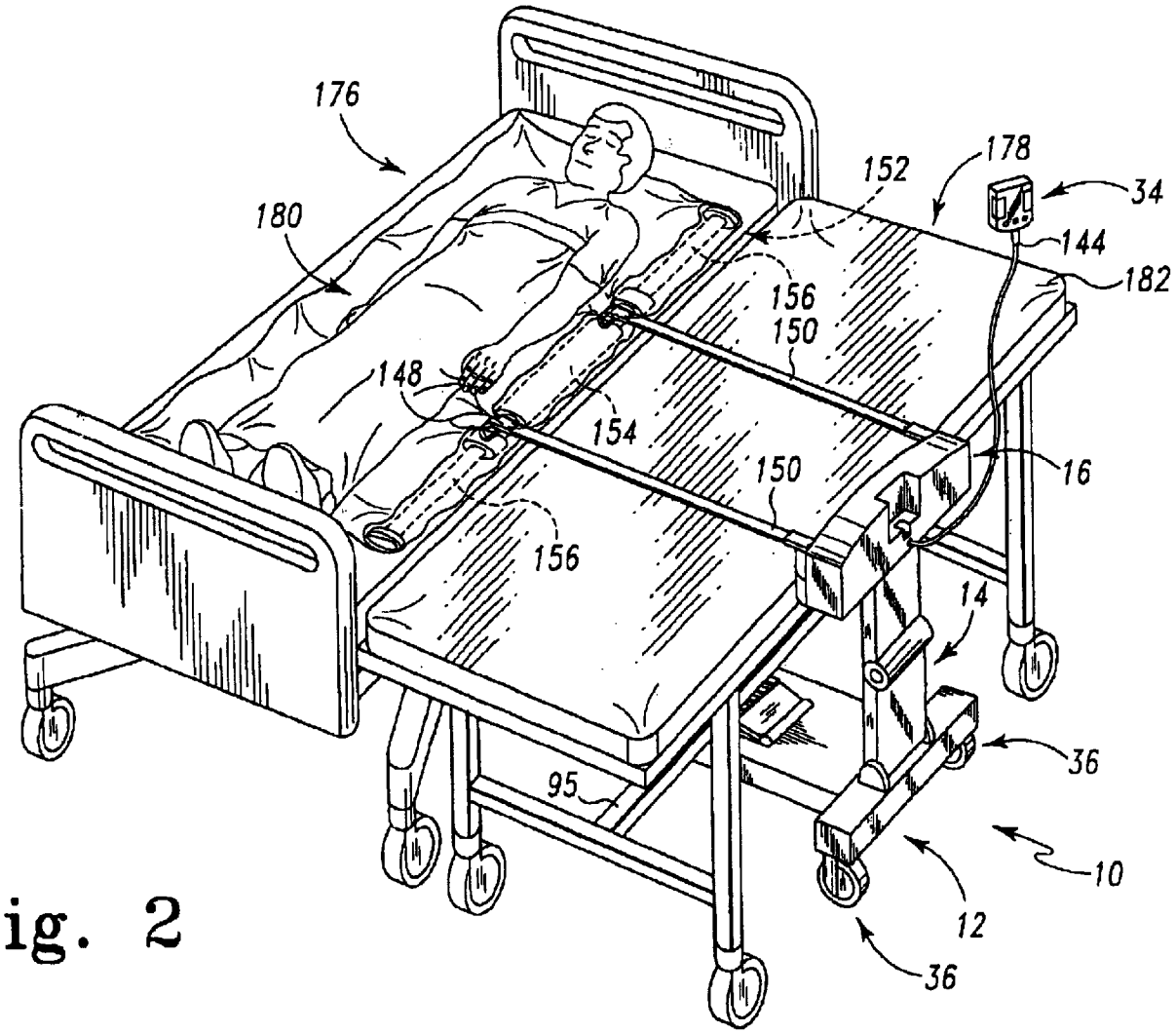
FIG. 2 is a perspective view showing a gurney positioned adjacent to the patient support with the patient transport apparatus positioned adjacent to the gurney to transfer a patient from the patient support to the gurney.

This clearance permits patient transport apparatus 10 to be removed from patient support 8 to be placed in storage or to be used with another patient support. For example, as shown in FIG. 2, patient transport apparatus 10 is positioned for use with a gurney or second patient support 178 positioned adjacent to first patient support 8 for transferring a patient from patient support 8 to gurney 178.

As mentioned above, patient transport apparatus 8 is configured to assist in such a transfer to gurney 178. As previously mentioned, patient transport apparatus 10 includes patient transfer apparatus 16 that is configured to assist in transferring a patient from one patient support to another and pedestal 14 that is configured to support patient transfer apparatus 16 on patient support mover 12.

During transfer of a patient from patient support 8 to gurney 178, patient transfer apparatus 16 pulls a sheet 180 on which the patient is positioned from patient support 8 to gurney 178. As sheet 180 is pulled over, the patient is also pulled over.

Before the patient is transferred, patient transfer apparatus 16 is positioned in the correct orientation relative to sheet 180, a connection rod 152 is wrapped in sheet 180, and patient transfer apparatus 16 is hooked onto connection rod 152. To properly orient patient transfer apparatus 16, it should be positioned at the correct height relative to gurney 178. The height of patient transfer apparatus 16 is adjustable to permit proper alignment of patient transfer apparatus 16 with a wide variety of patient supports. For example, if the patient is positioned on a patient support that has a rest surface that is lower than normal, the height of patient transfer apparatus 16 can be lowered to align with the lower patient rest surface. If the rest surface of a bed is higher than normal, the height of patient transfer apparatus 16 can be raised to align with the higher patient rest surface.

The configuration of pedestal 14 and its attachment to patient support mover 12 and patient transfer apparatus 16 facilitates this raising and lowering. Pedestal 14 includes a lower linkage 96, an upper linkage 98, and a linkage hinge 100 that pivotably couples lower and upper linkages 96, 98 together. A base hinge 28 is provided that pivotably couples lower linkage 96 to patient support mover 12. Upper linkage 98 is pivotably coupled to and supports patient transfer apparatus 16.

Figure 10:
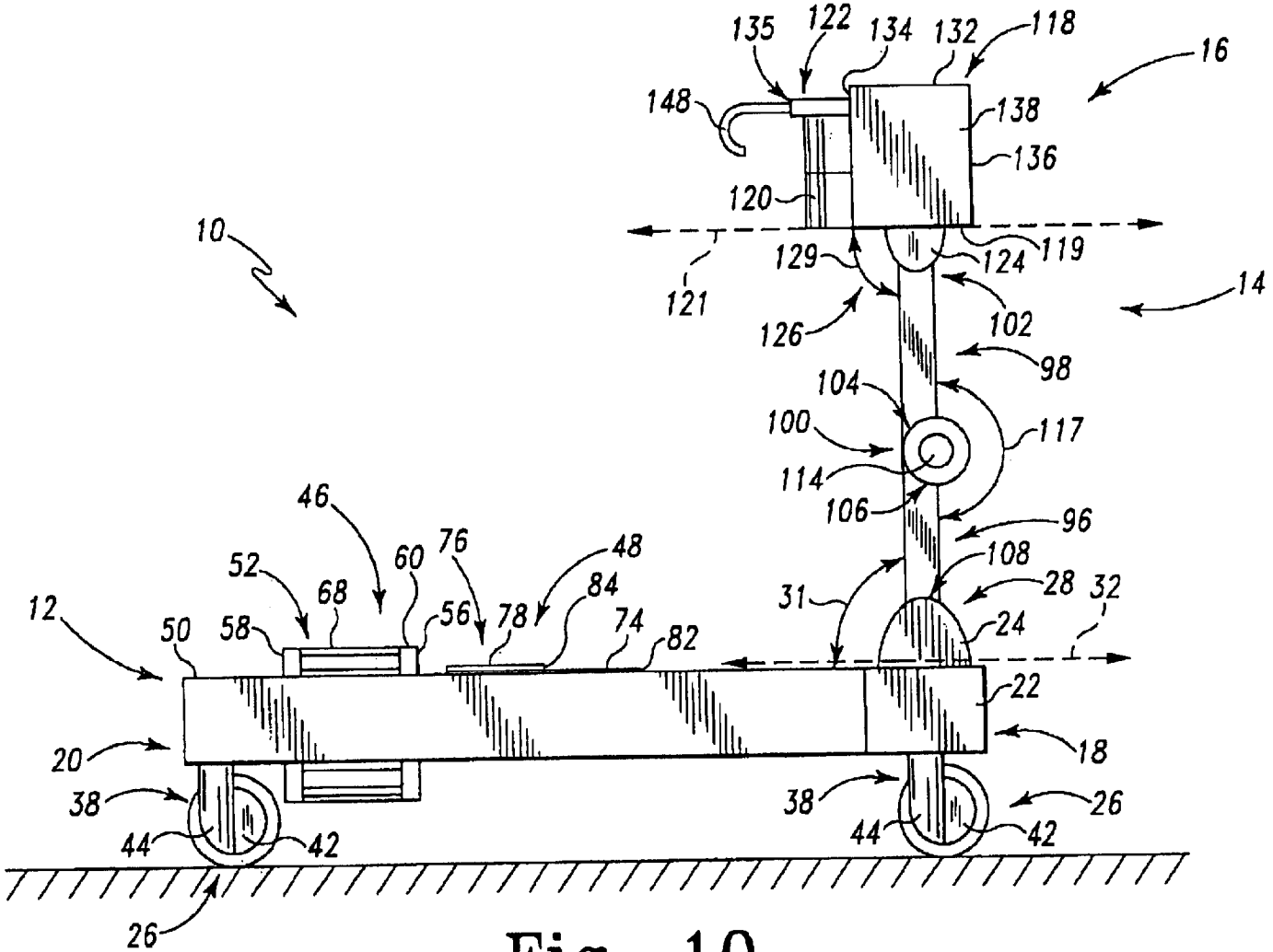
FIG. 10 is view similar to FIG. 8 showing the pedestal in a fully raised position.

As shown in FIGS. 8–10, rotation of lower and upper linkages 96, 98 about their respective pivot axis raises and lowers patient transfer apparatus 16. Upper linkage 98 includes a first end 102 that is pivotably coupled to a pedestal attachment 124 of patient transfer apparatus 16 and a second end 104 that defines a first portion 105 of linkage hinge 100. Lower linkage 96 is of the same dimensions as upper linkage 98 and likewise includes a first end 106 that defines a second portion 107 of linkage hinge 100 and a second end 108 that is pivotably coupled to a pedestal attachment 24 of patient support mover 12. Linkage hinge 100 includes first and second portions 105, 107 defined by upper and lower linkages 98, 96, an axle 114 that pivotably couples first and second portions 105, 107 together, and a position holder (not shown) that blocks or resists unwanted movement of upper and lower linkages 98, 96 relative to one another.

Axle 114 permits rotation of upper linkage 98 and lower linkage 96 relative to each other. As linkages 96, 98 rotate a linkage angle 117, or the angle between upper 98 and lower 96 linkages changes.

The position holder of hinge 100 helps prevent undesired changes in the relative position of linkages 96, 98 to maintain angle 117. Preferably, the position holder provides friction to hinge 100 so that a predetermined amount of force or torque is required to overcome the friction to rotate linkages 96, 98. According to alternative embodiments of the present disclosure, the position holder is a motor (not shown) which is controlled by a keypad 34 to permit powered raising and lowering. According to other alternative embodiments of the present disclosure, the position holder is a lock, latch, clutch, balanced hinge, or other device known to those of ordinary skill in the art to hold the relative position of the linkages.

The position holder operates to cause linkage hinge 100 and thus lower linkage 96 and upper linkage 98 to remain in place when not acted upon by a user so that patient transfer apparatus 16 is maintained in a desired elevation. To move patient transfer apparatus 16 to a different elevation, a caregiver or other user applies enough force to pedestal 14 or patient transfer apparatus 16 to overcome the position holder. According to the powered embodiment, the keypad is used to control the motor that moves the linkages relative to one another. Similarly, pedestal attachments 24, 124 are also provided with position holders (not shown) to maintain the desired position of linkages 96, 98 relative to patient support mover 12 and patient transfer apparatus 16.

Linkages 96, 98 and linkage hinge 100 are preferably constructed from a lightweight material that is able to support the weight of patient transfer apparatus 16. Linkages 96, 98 and linkage hinge 100 also have inner passages (not shown) defined therein. The passages are sized to permit wiring from keypad 34 to be run through linkages 96, 98 from patient transfer apparatus 16 to the drive motor and patient support mover 12. The wiring runs from patient transfer apparatus 16 to patient support mover 12 to permit control of the drive motor and the lift motor by keypad 34.

Figure 3:
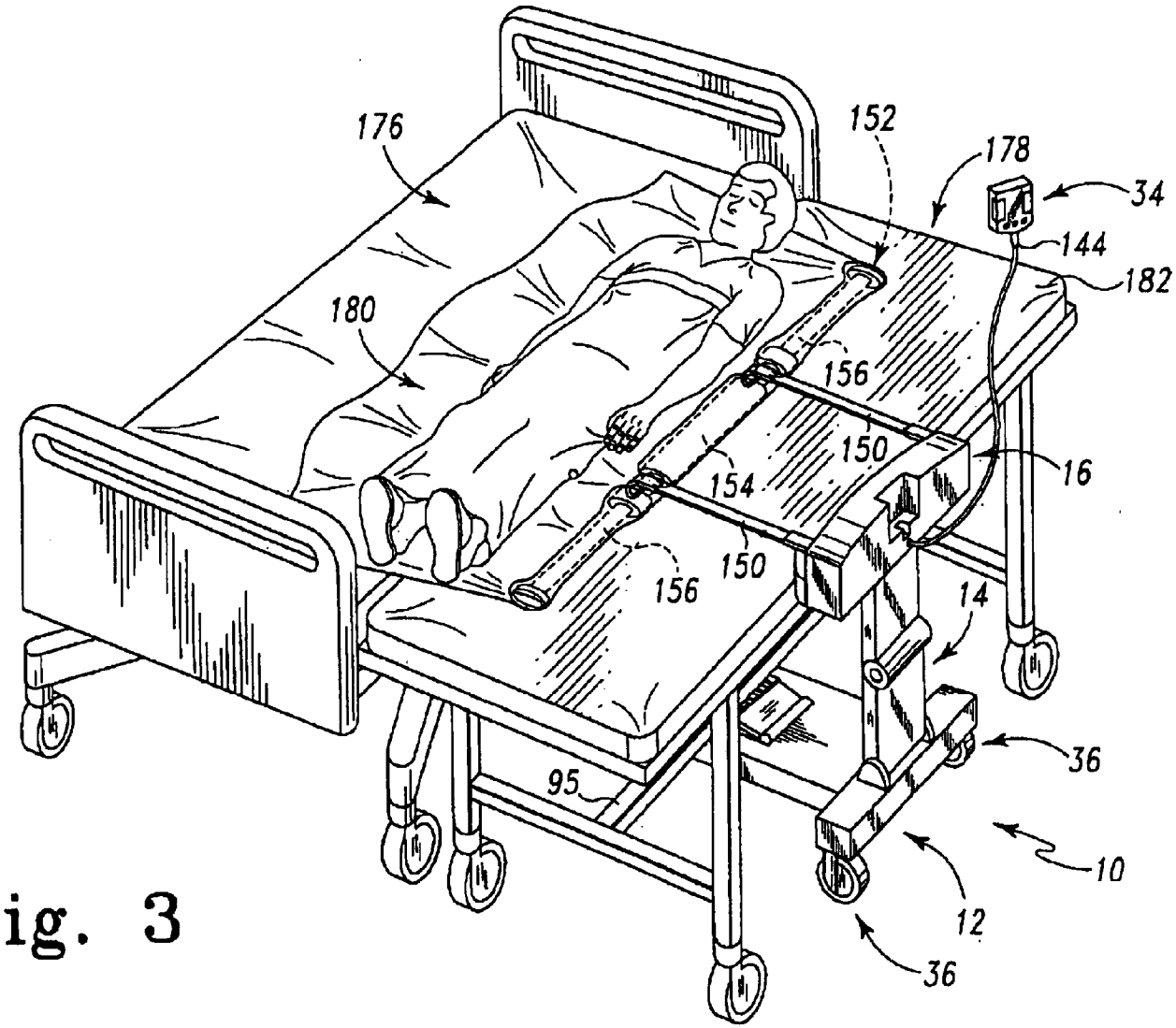
FIG. 3 is a view similar to FIG. 2 showing the patient transport apparatus pulling the patient from the patient support to the gurney.
Figure 4:
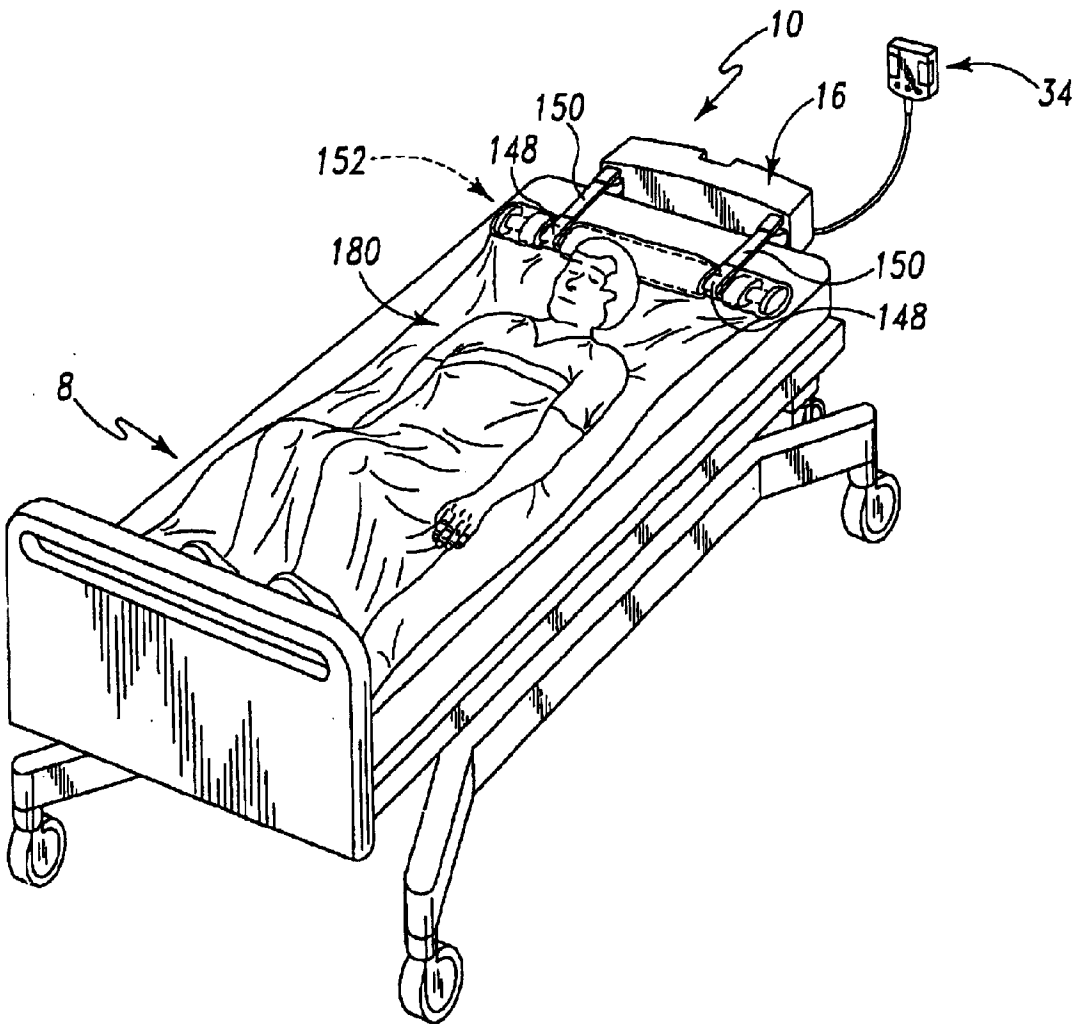
FIG. 4 is a perspective view showing the patent transport apparatus positioned adjacent a head end of the patient support to pull the patient toward the head end of the patient support.
Figure 5:
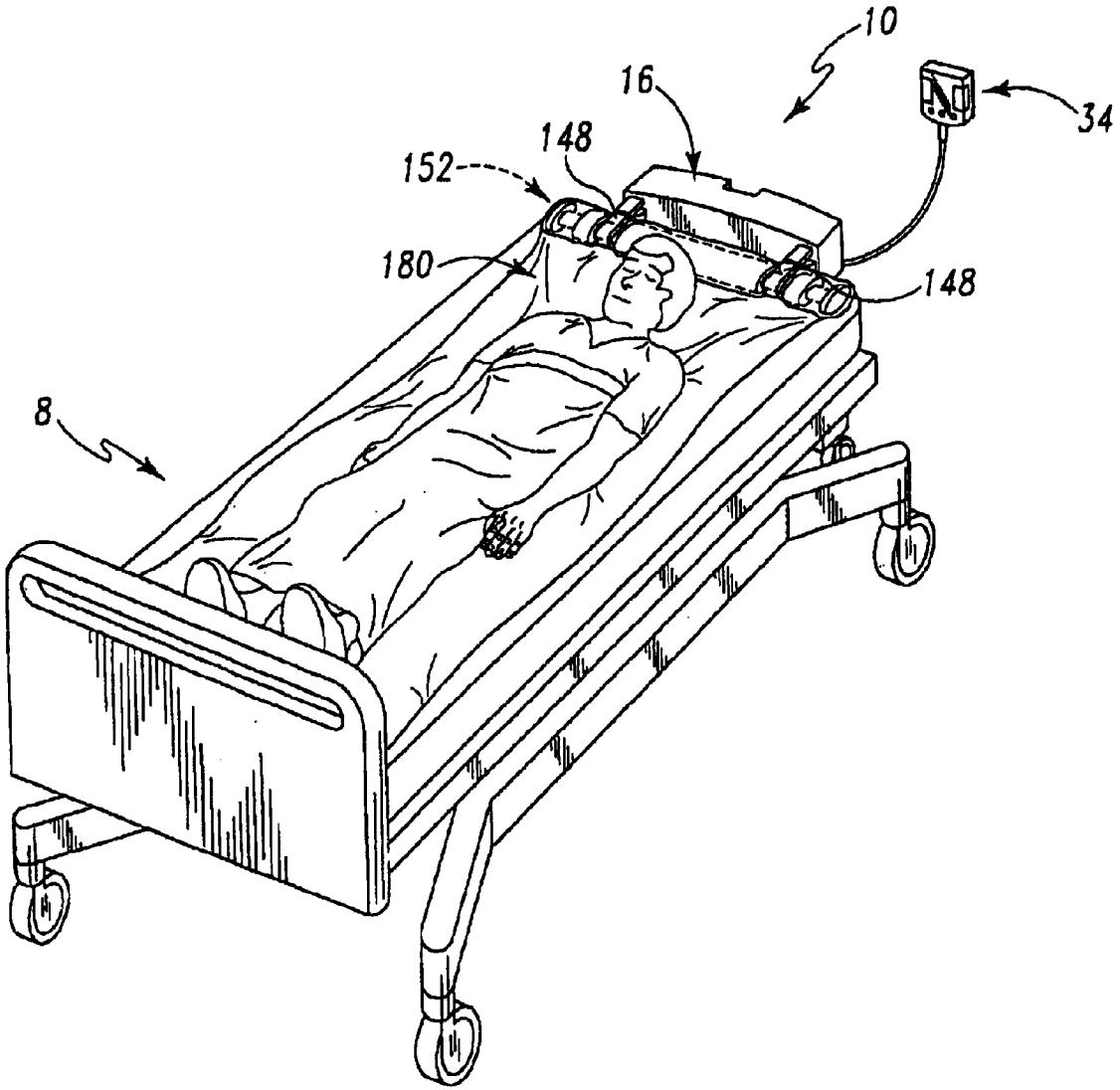
FIG. 5 is a view similar to FIG. 4 showing the patient pulled toward the head end of the bed.

According to the preferred embodiment of the present disclosure, linkages 96, 98 are defined by a pair of 4-bar linkages or other arrangement that maintains the angle of patient transfer apparatus 16 relative to the floor. For example, as shown in FIGS. 3–5, patient transfer apparatus 16 is maintained in a parallel relationship to the floor. According to alternative embodiments, the caregiver rotates the patient transfer apparatus to the correct orientation relative to the floor.

The configuration of pedestal 14 also maintains the position of patient transfer apparatus 16 relative to housing 50 so that patient transfer apparatus 16 is always positioned over the end of housing 50. For example, as pedestal 14 folds between the positions shown in FIGS. 8–10, patient transfer apparatus 16 remains positioned over pedestal attachments 24.

According to alternative embodiments of the present disclosure, other apparatus are provided to permit raising and lowering of the patient transfer apparatus. For example, according to one embodiment, telescoping members are provided to support the patient transfer apparatus. According to other embodiments, scissor mechanisms, other linkage arrangements, and other raising and lowering devices known to those of ordinary skill in the art are provided.

As previously mentioned, patient transfer apparatus 16 is supported by pedestal 14. Patient transfer apparatus 16 includes a housing 118, bumpers 120, patient movers 122, a transfer motor (not shown), and pedestal attachment 124. Pedestal attachment 124 extends below housing 118 and pivotably couples housing 118 to first end 102 of upper linkage 98. When force is applied to patient transfer apparatus 16 in a vertical manner, linkages 96, 98 "collapse" and causes the angle (hereinafter, the tower angle 129) between housing 118 to increase.

Housing 118 includes a bottom side 119, top side 132, patient support engaging side 134, user interface side 136, and pair of side ends 138. User interface side 136 includes a keypad recess 140 sized to receive keypad 34 and a cord recess 142 sized to receive a cord 144 coupled to keypad 34 as shown in FIG. 6. Keypad 34 remains positioned in keypad recess 140 until it is pulled form recess 140 by the user when moving patient transport apparatus 10 or transferring patient from one patient support 8 to another.

Cord 144 sends and receives electrical signals to and from keypad 34 to control the operation of the drive motor and patient transfer apparatus 16. Cord 144 consists of an electrically insulating sheath enclosing one or a plurality of wires capable of carrying electrical signals. Cord 144 attaches to and enters housing 118 through keypad cord void 142. Situated within housing 118, just inside keypad cord void 142 is a cord retractor (not shown). The cord retractor operates, depending on how cord 144 is pulled, to either retract cord 144 within housing 118, maintain the length of exposed cord 144, or allow cord 144 to be extended out of keypad cord void 142. According to an alternative embodiment, the keypad or controller is a remote controller that does not require a cord.

Keypad 34 includes a plurality of buttons 146, actuators, or the like. Buttons 146 control the operation of drive wheel 52, bracket 54, lift plate 74, and patient movers 122. Furthermore, keypad 34 includes a display that provides information to the user regarding the status and other operational information of patient transport apparatus 10 such as on/off, forward/reverse, speed, power level, and other operational information of apparatus 10.

Patient movers 122 are configured to hook onto connection rod 152 wrapped in sheet 180. Once hooked onto connection rod 152, patient movers 122 pull connection rod 152, sheet 180, and the patient positioned on sheet 180 onto gurney 178 as shown in FIGS. 2 and 3.

Each patient mover 122 includes a hook portion 148 that hooks over sheet 180 and connection rod 152 and extension straps or portions 150 that extend from housing 118 to hook portions 148. Hook portions 148 are preferably constructed from a hard plastic, metal, or other non-yielding material. Hook portions 148 are molded to have an arced hook thereon that matches portions of center pole 154. Extension portions 150 are preferably constructed from a thick woven fabric or other material having a high tensile strength and flexibility.

Figure 11:
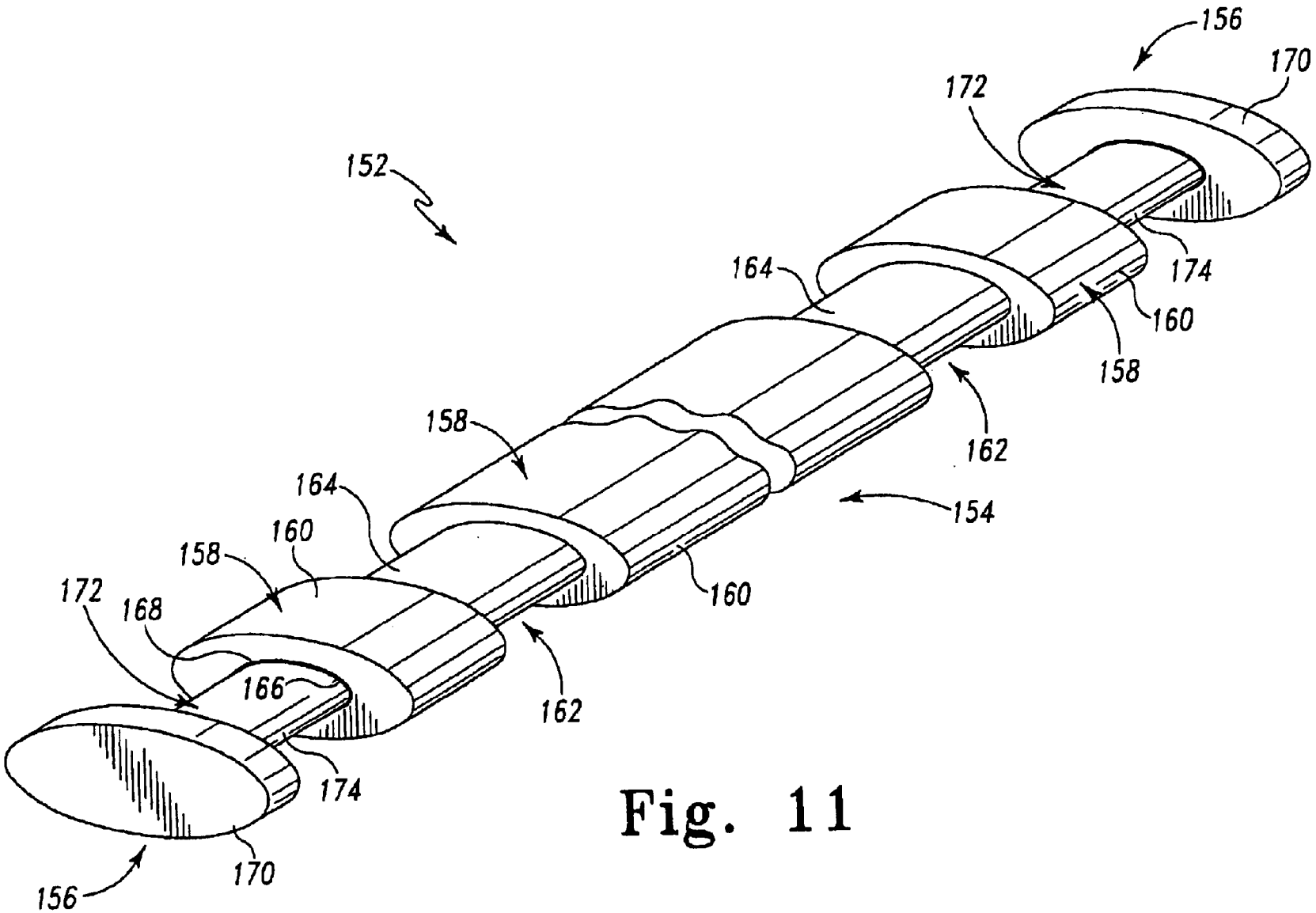
FIG. 11 is a perspective view of an extendable pole configured to with hook portions of the patient transfer apparatus of FIG. 6 showing the extendable pole including a base pole and a pair of telescoping extension poles.
Figure 12:
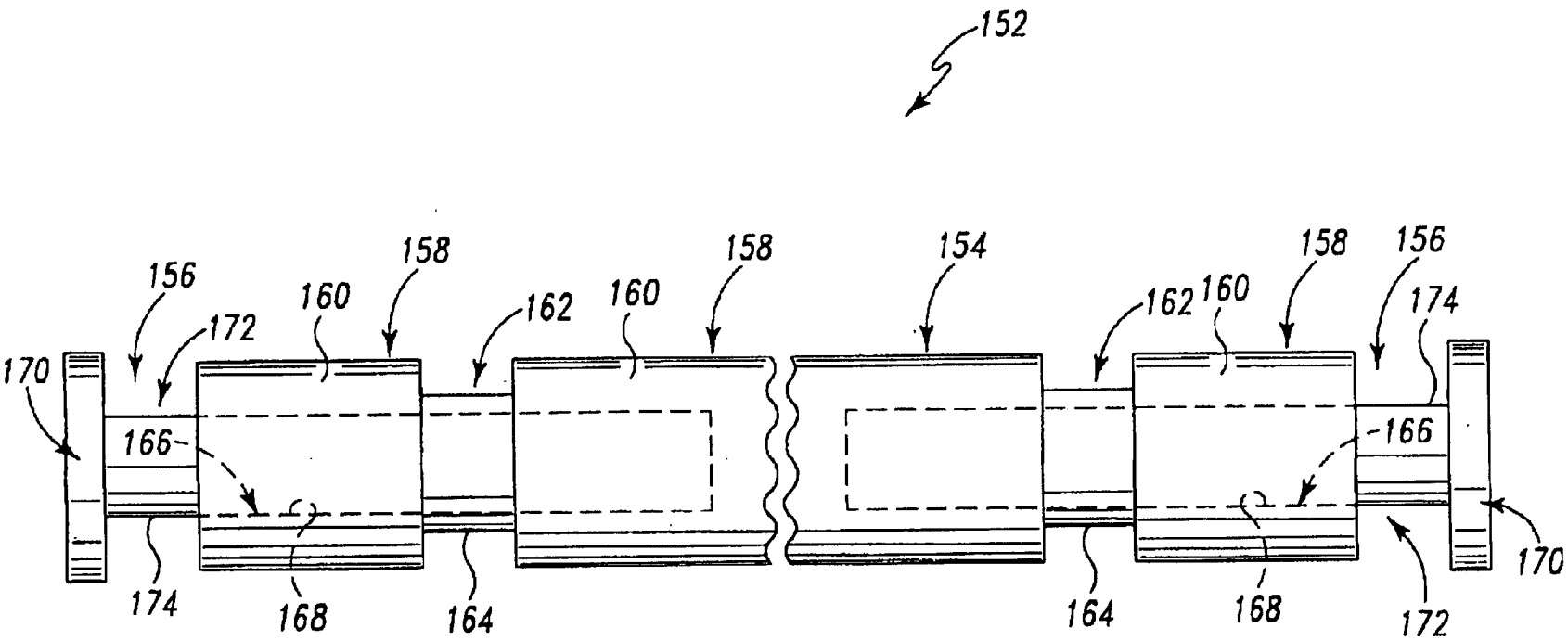
FIG. 12 is a side view of the extendable pole of FIG. 11 showing portions of the telescoping extension poles received within the base pole.

Connection rod 152 is configured to transfer the pulling force of patient movers 122 to sheet 180 and to facilitate hooking of patient movers 122 thereto. Connection rod 152, as shown in FIG. 11, includes a base or center pole 154 and two extension poles 156. Center pole 154 includes a plurality of first sections 158 having a first perimeter profile 160 and a plurality of second sections 162 having a second perimeter profile 164 that is less than profile 160 of first sections 158 and sized to receive hook portions 148 of patient movers 122. Center pole 154 further includes passage 166 defined therein sized to receive portions of extension poles 156 to permit extension and retraction of extension poles 156 as shown in FIG. 12.

Extension poles 156 include a head portion 170 having first perimeter profile 160 and an insertion portion 172 having a fourth perimeter profile 174. As shown in FIG. 11, perimeter profiles 160, 164, 168, 174 are all generally ovals of different sizes. According to alternative embodiments of the present disclosure, other profiles are provided, such as circles, squares, triangles, or non-uniform shapes.

Second perimeter profile 164 of second sections 162 is smaller than first profile 160 to snugly receive hook portions 148 of patient movers 122. Second sections 162 are sized to fit within the interior of the curvature of hook portions 148 of patient movers 122. The oval nature of second sections 162 prevents center pole 154 of connection rod 152 from rotating relative to hook portions 148 of patient movers 122 when hook portions 148 engage and pull on connection rod 152.

Passage 166 is sized to receive insertion portion 172 of extension poles 156 and to permit sliding of 156 extension poles 156 therein so that connection rod 152 has an adjustable length. Thus, extension poles 156 can be positioned such that varying amounts of insertion portions 172 are positioned within passage 166, thereby allowing connection rod 152 to assume a plurality of lengths. Passage 166 is also sized so that even though insertion portion 172 can slides within passage 166 when acted upon by a user, it is frictionally held in place when not acted on by a user or other force. The oval nature of passage 166 and insertion portion 172 also prevents insertion portion 172 from rotating within the passage, thereby ensuring that head portion 170 remains aligned with center pole 154.

Before hook portions 148 are positioned over connection rod 152, rod 152 is wrapped in sheet 180. If the patient is not already positioned on a suitable sheet 180, the patient is rolled to one side so that sheet 180 can be positioned over the other half of patient support 8. Then, the patient is rolled over to the half of patient support 8 with a portion of sheet 180 is positioned over the other half of patient support 8. The patient is then rolled back to the center of patient support 8. After the patient is centered on sheet 180, one of the longitudinal ends of sheet 180 is wrapped over connection rod 152 several times to provide a secure connection between rod 152 and sheet 180.

To move the patient, hook portions 148 are hooked over wrapped sheet 180 and connection rod 152. Next, extension straps 150 are retracted into housing 118 by the transfer motor. The retraction is preferably controlled by keypad 34. Retraction of straps 150 pulls connection rod 152, sheet 180, and the patient positioned thereon toward patient transfer apparatus 16 as shown in FIG. 3. Additional description of the internal and external components of a suitable patient transfer apparatus can be found in PCT Patent Application Serial No. PCT/US98/07140, titled PATIENT TRANSFER SYSTEM, to Ergodyne Corporation, the disclosure of which is expressly incorporated by reference herein.

Preferably, when the patient is centered on gurney 178, retraction of straps 150 is discontinued. Hook portions 148 are removed from connection rod 152 and sheet 180 is unwrapped from connection rod 152. If necessary, grip pad 76 is then raised into engagement with a frame member 95' of gurney 178 and drive mechanism 46 is used to transport gurney 178 about the care facility. Patient transport apparatus 10 is then moved away from gurney 178 for use one another patient support or into storage.

Housing 118 includes a pair of outlets 135 that feed extension straps 150 into and out of housing 118. Outlets 135 are sized to extend extension straps 150 over a pair of bumpers 120 coupled to housing 118.

Bumpers 120 are provided to provide a compliant surface for engagement with gurney 178 or other patient support during patient transfer. When patient transport apparatus 10 is positioned adjacent to gurney 178, bumpers 120 contact the side edge of gurney 178. When patient movers 122 pull in extension straps 150, bumpers 120 are slightly compressed between housing 118 and gurney 178 to provide a reactionary forces against which patient movers 122 can pull. This also helps protects patient transfer apparatus 16 from undesirable pressure points when engaging gurney 178 or other patient support 8 during transfer of a patient.

Preferably, bumpers 120 are half-cylinders positioned so that the rounded side faces away from patient support engaging side 134 of housing 118. Bumpers 120 are positioned under patient mover outlets 135 which are long enough to extend extension straps 150 thereover.

According to the preferred operation of patient transport apparatus 10, two different operations can be performed using patient transfer apparatus 16. As discussed above, patient transfer apparatus 16 can be used to transfer a patient from one patient support, such as patient support 8, to another patient support, such as gurney 178. After such as transfer, patient transport apparatus 10 can then be used to assist in moving gurney 178 to another location within the care facility.

Patient transfer apparatus 16 can also be used to reposition or change the position of a patient on a patient support which is explained in additional detail as follows. The first step of the transfer operation is to position the patient on sheet 180 as described above. Then, second patient support 178 is placed beside first patient support 176. Second patient support 178 is preferably of equal height as first patient support 176, or one or both of patient supports 176, 178 are of adjustable height and is adjusted to be of equal height. Patient transport apparatus 10 is then placed beside second patient support 178 on the side of second patient support 178 opposite first patient support 176 such that bumpers 120 engage second patient support 178. Placing patient transport apparatus 10 as such also necessitates that drive section 20 of patient support mover 12 is located beneath second patient support 178. The height of patient transfer apparatus 16 is adjusted as previously discussed such that patient mover outlets 135 of housing 118 of patient transfer apparatus 16 are level with an upper side 182 of second patient support 178.

The length of connection rod 152 is adjusted to fit the length of sheet 180 and the patient by extending or retracting extension poles 156 within center pole 154. Connection rod 152 is then rolled into the end of sheet 180 closest to second patient support 178. Next, connection rod 152 is rolled into sheet 180 such that sheet 180 surrounds connection rod 152. Sheet 180 preferably circumscribes connection rod 152 multiple times, but in some situations, one layer of sheet 180 is sufficient.

Patient movers 122 are extended from housing 118, and hook portions 148 of patient movers 122 are attached to second sections 162 of connection rod 152 over surrounding sheet 180. Hook portions 148 pull parts of sheet 180 down into second sections 162 of connection rod 152 and lock those parts of sheet 180 between second sections 162 of connection rod 152 and hook portions 148 as shown in FIG. 2.

The caregiver then presses buttons on keypad 34 to retract extension straps 150 of patient movers 122 into housing 118. By retracting straps 150, hook portions 148, the now attached connection rod 152, sheet 180, and the patient move toward housing 118 as shown in FIG. 3. When the patient is entirely positioned upon second patient support 178, the caregiver presses a second button, or releases the pressed button to stop the retraction of straps 150. The caregiver then detaches patient movers 122 from connection rod 152, and removes connection rod 152 from within sheet 180 and removes sheet 180, if necessary.

To transport the patient from one location in the care facility to another, patient transport apparatus 10 is coupled to gurney 178. Otherwise the patient transport apparatus 10 is placed in storage. During the transport function, pedestal 14 may remain in the raised position, but is most often placed in the lowered position as seen in FIG. 1. The health care provider can extend cord 144 to remove keypad 34 so as to be able to operate patient transport apparatus 10 at some distance away from housing 118, such as from the head or foot end of gurney 178.

The caregiver then presses one of the buttons on keypad 34 to raise pressure plate 76 and grip pad 76. Pressure plate 76 is raised until grip pad 76 engages frame member 95' or other part of gurney 178. Once grip pad 76 engages frame member 95' of gurney 178, further pressure is applied causing additional coupling between patient transport apparatus 10 and gurney 178.

Once patient transport apparatus 10 and second patient support 178 are coupled together through grip pad 78, the caregiver engages drive wheel 52 with the floor using keypad 34. Enough downward pressure is provided to drive wheel 52 so that traction surface 68 can utilize its high coefficient of friction on the floor to help prevent any slipping. Using keypad 34, drive mechanism 46 is then engaged to move patient transport apparatus 10 and gurney 178 to the desired location. Patient transport apparatus 10 is then removed to storage or to another patient support for moving the patient transport, transferring, or repositioning a patient.

As mentioned above, patient transport apparatus 10 may also be used to reposition a patient on patient support 8. For various reasons, patients sometime come to rest in positions that are undesirable and the patient cannot shift their position under their own power. For example, some patients supports are equipped with articulating decks that move between upright and bed positions. During articulation, patients positioned on such beds have a tendency to migrate toward the foot end of the bed. Some patients do not have enough strength to reposition themselves towards the head end of the bed. Therefore, they require some assistance to reposition themselves properly on the patient support.

Many caregivers do not have the necessary strength to adequately reposition such a patient. Thus, the caregiver, when necessary, can use the patient transfer apparatus to assist in repositioning the patient.

To reposition a patient on patient support 8, sheet 180 is positioned under the patient as described above. Next, patient transport apparatus 10 is positioned at either the head or foot end of patient support 8 as shown in FIG. 11. If necessary, headboard 13 is removed from patient support 8. Otherwise, straps 150 are fed under or through the headboard.

The height of patient transfer apparatus 16 is adjusted as previously discussed such that patient mover outlets 135 of housing 118 of patient transfer apparatus 16 are level with an upper side 182 of patient support 8. Patient transport apparatus 10 is placed adjacent to the head end of patient support 8 so that bumpers 120 engage patient support 8 and patient support mover 12 is positioned beneath patient support 8.

The length of connection rod 152 is then adjusted to fit the width of sheet 180 by extending or retracting extension poles 156 within center pole 154. By reducing the length of connection rod 152, it can fit between raised siderails (not shown) of the patient support where provided. Furthermore, by providing a connection rod 152 that has a reduced length that is less than the width of patient support 8 or mattress, connection rod 152 will not interfere with other apparatus positioned adjacent to patient support 8 such as medical devices, other bed components, the walls of the room, or other objects that may interfere if connection rod 152 were longer. According to alternative embodiments o the present disclosure other adjustable length connection rods are provided such as other telescoping members or other adjustable length configurations known to those of ordinary skill in the art.

Connection rod 152 is then rolled into the top edge of sheet 180 closest to patient transfer apparatus 16 in a manner similar to that described above. Patient movers 122 are extended from housing 118 and hook portions 148 of patient movers 122 are attached to second sections 162 of connection rod 152 over surrounding sheet 180. Hook portions 148 pull parts of sheet 180 down into second sections 162 of connection rod 152 and locks those parts of sheet 180 between second sections 162 of connection rod 152 and hook portions 148 as shown in FIG. 4.

The caregiver then presses the appropriate button on keypad 34 to retract extension straps 150 of patient movers 122 into housing 118. By retracting straps 150 into housing 118, hook portions 148, the now attached connection rod 152, sheet 180, and the patient move toward housing 118 as shown in FIG. 5. When the patient is properly positioned, the caregiver presses a second button, or releases the pressed button to stop the retraction of patient movers 122. The health care provider then detaches patient movers 122 from connection rod 152 and removes connection rod 152 from within sheet 180. According to an alternative embodiment of the present disclosure, the drive mechanism is oriented so that the patient support may be moved about by the patient transport apparatus when the patient transport apparatus is positioned at the head or foot ends of the bed.

Although the present invention has been described in detail with reference to preferred embodiments, variations and modifications exist within the scope and spirit of the present invention as described and defined in the following claims.

What is claimed is:

1. A patient transport apparatus configured to move a patient support having a patient rest surface, the apparatus comprising a patient support mover including a base, a plurality of wheels supporting the base on a floor, an attachment apparatus configured to couple the patient support mover to the patient support, and a drive mechanism configured to move the patient support relative to the floor, the drive mechanism including a wheel configured to move between a first position contacting the floor and a second position spaced apart from the floor, and a patient transfer apparatus supported by the patient support mover, the patient transfer apparatus being configured to move a patient from a first position on the patient rest surface of the patient support to a second position.

2. The patient transport apparatus of claim 1, further comprising a support member configured to support the patient transfer apparatus on the patient support mover, the support member is adjustable from a first length supporting the patient transfer apparatus at a first height above the floor to a second length supporting the patient transfer apparatus at a second height above the floor that is greater than the first height.

3. The patient transport apparatus of claim 1, wherein the attachment apparatus is configured to move relative to the patient support from a first position in contact with the patient support and a second position spaced apart from the patient support.

4. A patient transport apparatus configured to move a patient from a first position on a patient rest surface of a patient support to a second position, the apparatus comprising a base, a patient transfer apparatus configured to move the patient from the first position on the patient rest surface to the second position, a support member positioned to support the patient transfer apparatus on the base and permit adjustment of the position of the patient transfer apparatus relative to the base such that the patient transfer apparatus corresponds to the height of the patient rest surface, a drive mechanism configured to move the base relative to the floor and an attachment apparatus configured to couple the base to the patient support.

5. A patient transport apparatus configured to move a patient from a first position on a patient rest surface of a patient support to a second position, the apparatus comprising a base, a patient transfer apparatus configured to move the patient from the first position on the patient rest surface to the second position, and a support member positioned to support the patient transfer apparatus on the base and permit adjustment of the position of the patient transfer apparatus relative to the base such that the patient transfer apparatus corresponds to the height of the patient rest surface, the support member permitting adjustment of the position of the patient transfer apparatus relative to the base while the apparatus is coupled to the patient support.

6. The patient transport apparatus of claim 5, wherein the support member has a first length supporting the patient transfer apparatus at a first height above the floor and a second length supporting the patient transfer apparatus at a second height above the floor that is greater than the first height.

7. The patient transport apparatus of claim 5, wherein the base has first and second ends and the support member is positioned adjacent to the first end and is spaced apart from the second end.

8. A patient transport apparatus configured to move a patient from a first position on a patient rest surface of a patient support to a second position, the apparatus comprising a base, a patient transfer apparatus configured to move the patient from the first position on the patient rest surface to the second position, a support member positioned to support the patient transfer apparatus on the base and permit adjustment of the position of the patient transfer apparatus relative to the base such that the patient transfer apparatus corresponds to the height of the patient rest surface, the support member including a first linkage pivotably coupled to the base and a second linkage pivotably coupled to the first linkage, and the patient transfer apparatus being pivotably coupled to the second linkage.

9. The patient transport apparatus of claim 8, wherein pivoting movement of the first linkage relative to the base, the second linkage relative to the first linkage, and the patient transfer apparatus relative to the second linkage lowers the height of the patient transfer apparatus relative to the base.

10. The patient transport apparatus of claim 9, wherein the lateral position of the patient transfer apparatus relative to the base remains substantially constant during lowering of the patient transfer apparatus relative to the base.

11. The patient transport apparatus of claim 8. wherein the first linkage has a first length and the second linkage has a second length that is substantially equal to the first length.

12. A patient transfer apparatus configured to move a patient from a first position on a patient rest surface to a second position, the patient transfer apparatus comprising:

a rod configured to be coupled to a sheet positioned under a patient, the rod being adjustable from a first length to a second length that is greater than the first length, and a patient mover coupled to the rod to translationally move the rod, the sheet, and patient positioned thereon from the first position to the second position.

13. The patient transfer apparatus of claim 12, wherein the rod includes a plurality of telescoping members.

14. The patient transfer apparatus of claim 12, wherein the rod includes a base pole and an extension pole that slides relative to the base pole to adjust then length of the rod.

15. The patient transfer apparatus of claim 14, wherein the base pole includes a pair of hook-receiving portions sized to receive hook portions of the patient mover.

16. A method of moving one or more patients laterally and longitudinally on a patient support having head and foot ends and first and second spaced apart sides extending between the head and foot ends, the method comprising the steps of providing a rod configured to couple with a sheet positioned under a patient supported on a patient support and a patient mover configured to couple with the rod and move the rod, sheet, and patient relative to the patient support, coupling the rod to a sheet to extend longitudinally relative to the patient support, moving the rod and sheet laterally with the patient mover to move a patient, uncoupling the rod from the sheet, coupling the rod to a sheet to extend laterally relative to the patient support, moving the rod and sheet longitudinally with the patient mover to move a patient, and adjusting the length of the rod between the moving steps.

17. The method of claim 16, further comprising the step of moving the rod between a first position adjacent to one of the first and second sides of the patient support and a second position adjacent to a head end of the patient support.

18. The method of claim 16, wherein the patient mover is positioned adjacent to the patient support during the step of moving the rod and sheet longitudinally.

* * * * *